US005175792A

United States Patent [19]

Lefebvre

[11] Patent Number: 5,175,792

[45] Date of Patent: Dec. 29, 1992

[54] LOW LIQUID LEVEL ADVANCE WARNING ALARM SYSTEM WITH SAFETY SHUT-OFF

[76] Inventor: Frederick L. Lefebvre, 700 Solano Prado, Coral Gables, Fla. 33156

[21] Appl. No.: 601,027

[22] Filed: Oct. 23, 1990

Related U.S. Application Data

[63] Continuation of Ser. No. 417,280, Oct. 5, 1989, abandoned.

[51] Int. Cl.[5] ..... F24H 1/00

[52] U.S. Cl. ..... 392/498; 392/451; 392/501; 219/494; 219/512; 219/523; 219/553

[58] Field of Search ..... 392/498, 451, 501; 219/494, 523, 541, 544, 553, 512

[56] References Cited

U.S. PATENT DOCUMENTS

| | | | |
|---|---|---|---|
| 2,839,660 | 6/1958 | Davies | 219/327 |
| 4,156,128 | 5/1979 | Craven | 219/331 |
| 4,234,785 | 11/1980 | Lefebvre | 219/523 |
| 4,238,666 | 12/1980 | Pomper | 219/523 |
| 4,327,281 | 4/1982 | Jager et al. | 219/318 |
| 4,551,619 | 11/1985 | Lefebvre | 219/523 |
| 4,707,590 | 11/1987 | Lefebvre | 219/523 |

*Primary Examiner*—Bruce A. Reynolds
*Assistant Examiner*—Tu Hoang
*Attorney, Agent, or Firm*—Watts, Hoffmann, Fisher & Heinke

[57] ABSTRACT

An advance warning control system for controlling the liquid level in a heating tank including an electrical immersion heater to provide a source of radiant energy, a control means operably associated with the immersion heater and the control means including a first normally open bi-metallic switch and a second normally closed bi-metallic switch which together operate to provide an advance warning upon energization of the first switch to give a predetermined time interval before energization of the second switch.

8 Claims, 2 Drawing Sheets

LOW LIQUID LEVEL ADVANCE WARNING ALARM SYSTEM WITH SAFETY SHUT-OFF

This is a continuation of copending application Ser. No. 07/417,280 filed on Oct. 5, 1989.

TECHNICAL FIELD

The present invention relates to a liquid level control system and more particularly to an improved low liquid level control system which incorporates advance warning and safety functions for use in electric immersion heater applications.

In the invention and in a preferred form, a first normally open bi-metallic switch (thermostat) is operably associated with a second normally closed bi-metallic switch (thermostat) to provide advance warning (i.e., audible or visual) prior to actuation of the second switch. This acts as an automatic fail-safe for shut-off, if necessary, of the immersion heater for a particular tank upon actuation of the switch from the common radiant energy source resulting from the exposed hot-zone of the emersion heater.

RELATED PATENTS

This application is related to applicant's prior U.S. Pat. No. 4,234,785 granted Nov. 19, 1989 for Low Liquid Level Response Control Device. This patent has a particular application in the plating industry and the disclosure of such Patent is incorporated herein by reference.

BACKGROUND OF THE INVENTION

Heretofore, it has been known to provide various types of liquid control devices and/or systems for controlling the liquid level in processing tanks, such as used in the plating industry. For example, reference may be had to applicant's aforesaid U.S. Pat. No. 4,234,785. In such applications, it is necessary that the liquid level be maintained in the plating tank since the lowering of the level below the upper end of the ¢hot zone" of the radiating immersion heaters can result in damage and/or destruction to the heaters and/or tanks making it important to have a low liquid level advance warning and control system.

The applicant's prior U.S. Pat. No. 4,234,785 exemplifies a marked improvement over prior art controls previously in the form of float devices and micro-switches which were unreliable and adversely affected by the environment. Other prior art controls have included capacitors and/or proximity switches which are not satisfactory. Though the control system of applicant's prior U.S. Pat. No. 4,234,785 solved many of these problems, it did not provide an advance warning alarm and safety feature. In applicant's prior patent, a low liquid level responsive control device is operated by the exposed "hot zone" of the immersion heater by means of a bi-metallic (normally) thermostat in conjunction with a fail-safe fuse (non-recycling) which acts as a back-up by having a higher temperature rating. Accordingly, it will seem that this type of control system does not provide an advance warning to enable shut-off of specific heaters where the tanks experience a low liquid level. It has been found that this is extremely important particularly in the electronic industries printed circuit and micro-chip manufacturing processes.

This problem can be appreciated when it is recognized that in a typical plating or printing circuit production lines, the lines consist of a series of plating tanks through which the parts to be plated and/or treating are conveyed. In such case, if one tank is shut-down for any reason (i.e., low liquid level) this can cause a shut-down of the entire line resulting in substantial delay in hence, expense.

Accordingly, in the present invention it will be seen an advance warning alarm and safety shut-off system is provided that eliminates the above difficulties and provides an advance warning to the operator. This allows the operator to correct and/or deal with the problem without having to shut-down the entire production line. It has been found that the system of the inventor gives an operator of a high production line at least one hour to correct the problem before having to shut-down the line due to a cold tank.

It has been found that this improved system is relatively inexpensive to manufacture and provides reliable results to maximize the efficiency of continuous plating lines particularly in the printed circuit and micro-chip manufacturing industry. Other advantages and objects to the present invention will become apparent as the following description proceeds when taken in conjunction with the following drawings.

DESCRIPTION OF THE PREFERRED EMBODIMENTS

Figure 1A:
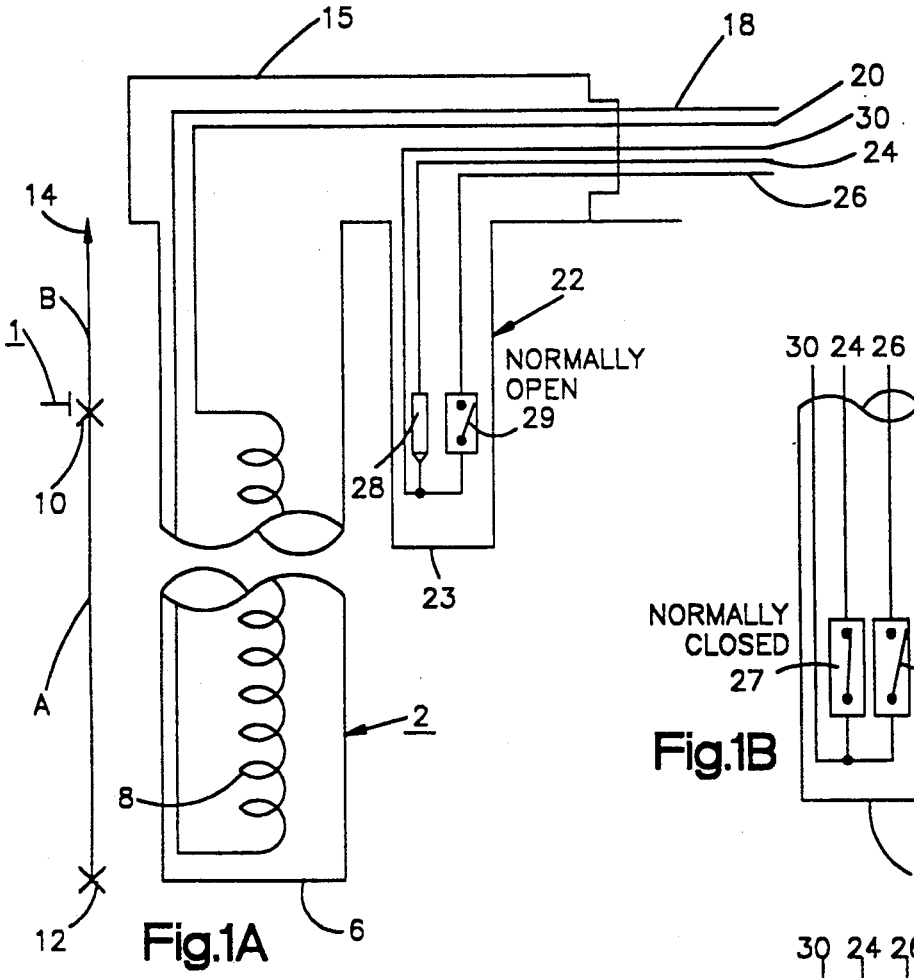
FIG. 1A is a vertical section view, partly fragmentary, showing one form of the control system of the present invention with an electric immersion heater of the type illustrated in FIG. 1 of applicant's U.S. Pat. No. 4,234,785, and showing a normally open bi-metallic switch with a non-recycling fuse.

Referring again to the drawings and in particular FIG. 1A thereof, there is illustrated fragmatically a general type of electric immersion heater illustrated in U.S. Pat. No. 4,234,785. As shown, the immersion heater 1 includes a quartz or metal tube that is designated generally at 2, which has a lower sealed end, as at 6, for containing the liquid heating media. In the tube 2 there is incorporated a suitable heating element in the form of a resistance coiled heating wire, as at 8, which may be mounted on a suitable support structure in a manner as illustrated in U.S. Pat. No. 4,234,785. The coiled wire element 8 may include a wire of nichrome or the like which provides a hot-zone, indicated at A, extending from the line 10 to the lower end at 12 and a cold zone B extending from the line 10 upwardly to the line indicated at 14 (top of heater tube).

As recognized in applicant's prior U.S. Pat. No. 4,234,,785, the heater tube 2 may be made of quartz or metal heated to radiant temperature. The heater typically includes a cover 15 and suitable electrical connections which lead to electrical conductors 18 and 20 for actuation by a suitable power source (not shown) as known in the art.

Now in this invention and disposed adjacent the heater tube 2 is a control tube, as at 22, preferably made of a quartz or metal which is similarly sealed at its end, as at 23. This second tube is disposed preferably in parallel relationship to the heater tube 2 and may be in contact with or spaced slightly apart from the heater tube. In the second tube 22 is disposed a first normally open, bi-metallic switch (thermostat), as at 29, which has an electrical lead 26 extending therefrom. In this embodiment, a fail-safe fuse of a non-recycling type, as at 28, is provided and has a suitable lead 30 which is connected in circuit with normally open switch 29. It will be seen that the normally open switch 29 and fuse 28 are disposed in parallel relationship and generally adjacent the top of the hot zone of the immersion heater and immediately below the cold zone. By this arrangement, when the radiation is developed by the heater element 8, the infra-red nature thereof will cause the radiation to pass through the respective quartz tubes or heat the metal tube to radiant temperature. In such case, because of the differential temperature rating of the switch and fuse, an advance warning (audible or visual) is given to the operator before actuation of the fuse 28 by reason of a drop in the liquid level in the plating tank.

Figure 1B:
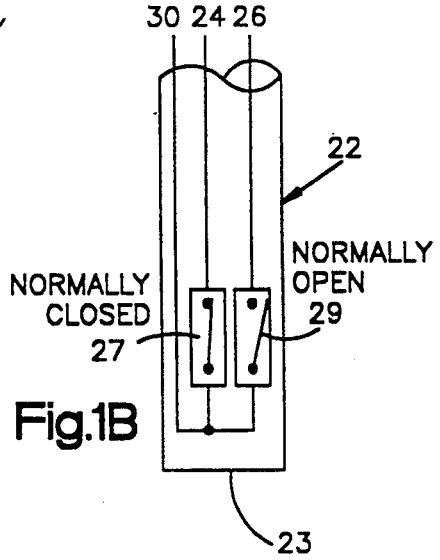
FIG. 1B is a fragmentary, schematic view illustrated a normally open, bi-metallic switch (thermostat) with a normally closed bi-metallic switch (thermostat) shut-off.
Figure 1C:
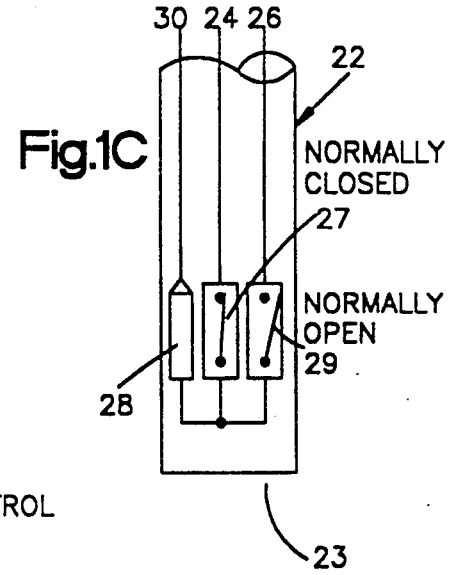
FIG. 1C is a fragmentary, schematic view illustrating a normally open, bi-metallic switch (thermostat), and a normally closed back-up bi-metallic switch (thermostat) shut-off, and a fail safe fuse shut-off for d shut-off protection.

In FIGS. 1B and 1C there are illustrated modifications of the advance warning system of the present invention wherein the control tube mounts a first normally open bi-metallic switch 29 and a second normally closed bi-metallic switch 27 (thermostat). The switch 27 acts as a heater shut-off after the advance signal provided by the first normally open bi-metallic switch. In FIG. 1C the control tube 22 contains a first normally open bi-metallic switch 29 (thermostat), a second normally closed bi-metallic switch 27 (thermostat) which acts as a heater shut-off, and a fail-safe fuse 28, backup, as described in connection with FIG. 1 (heater shut-off).

Figure 1D:
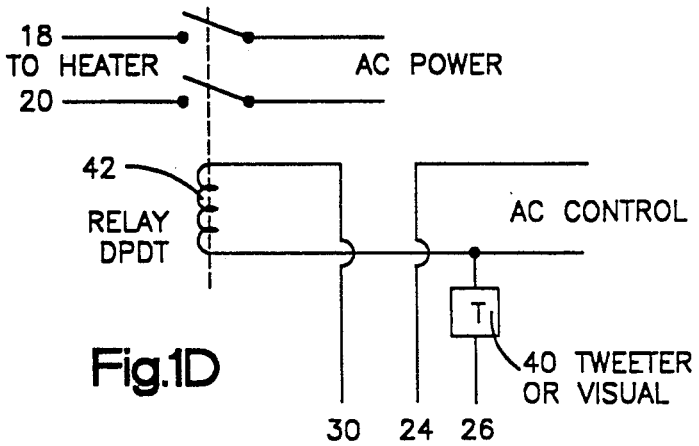
FIG. 1D is a schematic control circuit for the early alarm systems in accordance with the invention.

In FIG. 1D there is schematically illustrated a typical diagrammatic illustration showing the circuitry for controlling the advance warning system of the invention. As shown, the heater leads 18 and 20 are energized by a suitable source of AC power with the leads 24, 26, and 30 from the control tube 22 being connected in circuit to the power source. An alarm 40, such as a visual or audible device, is disposed in circuit with the electrical leads and the relay 42 from the fail-safe fuse or from the normally closed bi-metallic switch to provide a shut-off for the immersion heater should the liquid level in the tank drop below a predetermined level of the hot zone.

Accordingly, in the invention it will be understood that where the liquid level drops for any reason to a point where the fully open bi-metallic switch is exposed to direct radiation from the heating coil 8, without the surrounding fluid, the direct radiation will cause an immediate increase in temperature for actuation of the (tweeter) switch 29 being bi-metallic, it will close. Immediately upon opening of the normally closed switch 24, the circuit through the leads will open the circuit to the heater or to the fail-safe fuse backup, if switch 24 fails to close. Actuation of the first normally open switch 29 provides an advance signal which gives the operator ample time to correct the problem before having to shut-down the production line due to a cold tank. It will be understood that the signal from the signaling fully open switch may include a horn, tweeter, and/or a signal light, desired.

Figure 2A:
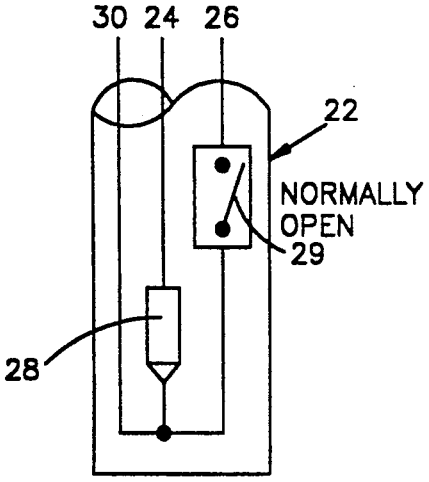
FIG. 2A, 2B, 2C, 2D, and 2E illustrate further modifications in respect to the arrangement between the normally open bi-metallic switch (thermostat), the normally closed bi-metallic switch (thermostat) and the non-recycling fail-safe fuse.
Figure 2B:
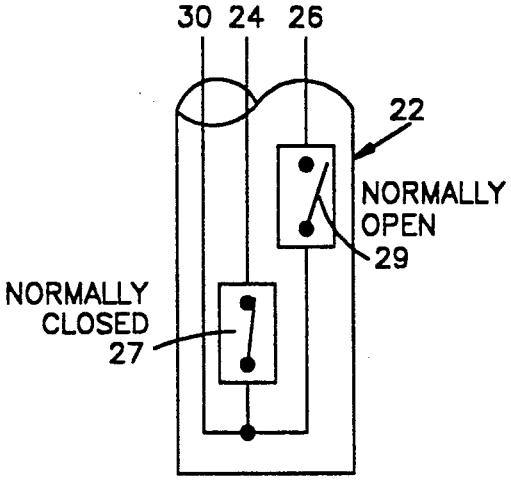
Figure 2C:
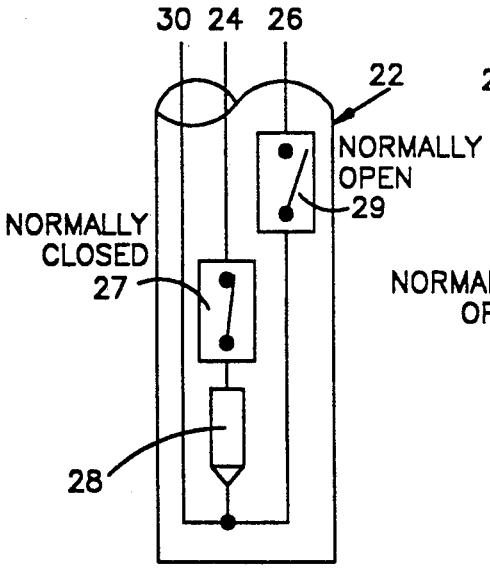
Figure 2D:
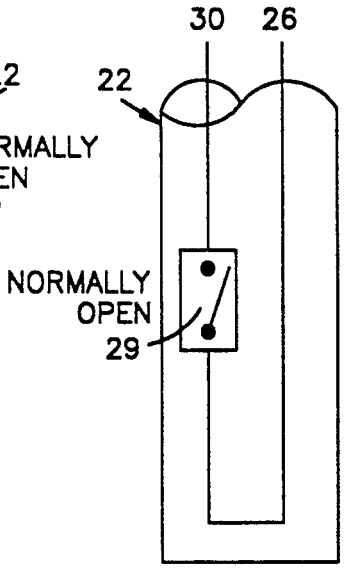
Figure 2E:
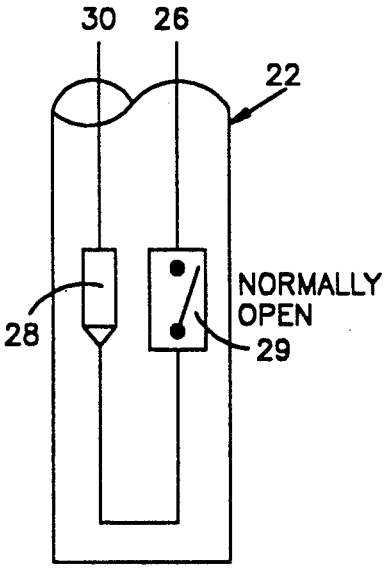

In FIGS. 2A–2E, there are illustrated further modified embodiments of the invention. In FIG. 2A, it will be seen that the first normally open bi-metallic switch 29 (thermostat) is located above the non-recycling fail-safe fuse 28. In such case, the temperature rating on the normally open bi-metallic switch will be such that an advance signal is provided resulting from lowering of the liquid level before energization of the fail safe fuse 28. In FIG. 2B, the first normally open bi-metallic switch 29 is located above a second normally closed bi-metallic switch 27. In FIG. 2C, the non-recycling fail-safe fuse 28 is located below a first normally closed bi-metallic switch 27 (thermostat) which, in turn, is located below a second normally open bi-metallic switch 29 (thermostat). In FIG. 2D, there is illustrated a normally open bi-metallic switch 29 without 27 the normally closed bi-metallic switch or the non-recycling fuse 28. In FIG. 2E, there is illustrated a normally open bi-metallic switch 29 (thermostat) in circuit with a non-recycling fuse 28.

Figure 3A:
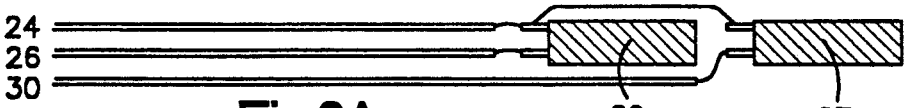
FIGS. 3A and 3B illustrate further modifications of the advance warning system of the present invention which allows use of smaller diameter heater tubes by reason of the normally open and normally closed and/or fail-safe fuse being disposed in a tandem relationship rather than in the side-by-side parallel relationship as illustrated in FIGS. 2A–2E.
Figure 3B:
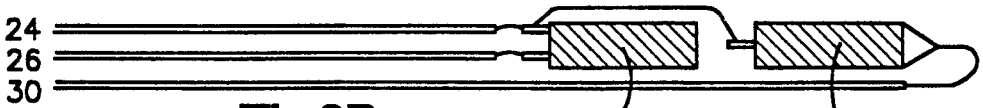

In FIGS. 3A and 3B, there is illustrated a further embodiment of the present invention. As illustrated in FIG. 3A, a first normally open bi-metallic switch 29 (thermostat) is located above a second normally closed bi-metallic switch 27 (thermostat) but it is seen that the switches are disposed in a tandem relationship. That is, one above the other. By this arrangement, substantially reduced size, diameter, quartz or metal tubes may be utilized for the control function. For example, in this case, the first normally open switch 29 may have a temperature rating of approximately 120° C., whereas, that for the second normally closed switch 27 would be approximately 152° C. such that the first switch is energized to provide the warning signal prior to actuation of the second or shut-off switch 27. It can be understood, however, that the temperature ratings may be equal since the axially spaced, tandem relationship of the switches would also provide the necessary advanced warning, as desired. In the modification of FIG. 3B, the normally open bi-metallic switch 29 (thermostat) is disposed above a non-recycling fail-safe fuse 28 which could, for example, have a temperature rating of approximately 152° C. for a plating tank having a capacity of 50 to 1000 gallons.

In the invention, the normally closed bi-metallic may have a temperature rating of 152° C. and the normally open thermostat a temperature rating of 128° C. (FIG. 3); and the fail-safe fuse, as at 28, a rating of 152° C. such that the upper thermostat (switch) is activated in advance of the fail-safe switch or fuse. The thermostat 29 may be of the PEPI (CR) type and the thermostat 27 the PEPI (13) type manufactured by Elmond and Portage Electric Inc. The conductor elements, in all cases, as at A, B, and C, may be Teflon covered 18 polymer wire leads. The leads may have a length of about 18 inches and the axial length of the thermostats 27 and 29 being about 2¼ inches. This polymeric material is disclosed in applicant's U.S. Pat. Nos. 4,551,619 and 4,707,590.

It will be recognized that the advance warning control system of the present invention may be utilized with any number of electric emersion heaters for use with one or more plating tanks for a continuous production line application, as desired. Also, it would be recognized that the control tube may be comprised of stainless steel or the like and then disposed through the heater coil as illustrated in FIG. 5 of application's U.S. Pat. No. 4,234,785 with the recycling and non-recycling switches and or fuses located within the control tube.

Other advantages and objects of the present invention are contemplated within the scope of the appended claims.

I claim:

1. An advance warning control system for controlling the liquid level in a heating tank comprising an electrical immersion heater adapted to provide a source of radiant energy, a control means operably associated with said immersion heater and said control means including a first normally open bi-metallic switch and a second normally closed bi-metallic switch which together are operative, in circuit, to provide an advance warning upon energization of said first switch thereby to give a predetermined time interval before energization of said second switch.

2. In an advance warning system in accordance with claim 1, including a non-recycling fuse means in circuit with said fuse to provide a fail-safe for said system.

3. In an advance warning system in accordance with claim 1, wherein said first and second switches have a predetermined differential temperature rating so as to provide a temperature energization differential between said first and second switch.

4. In an advance warning system in accordance with claim 1, wherein the first switch is physically oriented and spaced a sufficient distance from said second switch to give advance warning upon energization of said first switch in advance of said second switch.

5. In an advance warning system of the type for use in a liquid heating tank, such as in electronic plating applications, comprising a liquid heating tank containing a heating media, at least one electric immersion heater disposed for heating the liquid in said tank, said immersion heater including a heater means, containing an electrical heating wire element disposed in said tube and adapted for energization from a power source, a control tube disposed generally adjacent and parallel to said heater tube and containing temperature responsive control means therein, said temperature responsive control means including a first normally open bi-metallic, non-recycling fail-safe fuse and a second normally closed bi-metallic switch adapted to be energized by said first switch in response to a radiant energy produced by the common radiant energy from said heating element resulting from lowering of the liquid level in said tank.

6. The advance warning system in accordance with claim 1, wherein said heater tube means and said control tube means are made from a quartz material.

7. An advance warning system in accordance with claim 1 wherein said heater tube means and said control tube means are made of steel alloys and other metals such as titanium, copper alloys, capable of withstanding temperatures over 1000° F.

8. An advance warning system in accordance with claim 5 wherein high temperature plastics such as fluorocarbons covers the heater wire element.

* * * * *